US012103803B2

(12) United States Patent
Kurata et al.

(10) Patent No.: US 12,103,803 B2
(45) Date of Patent: Oct. 1, 2024

(54) CASSETTE AND PRINTING APPARATUS

(71) Applicant: CANON KABUSHIKI KAISHA, Tokyo (JP)

(72) Inventors: Tetsuji Kurata, Kanagawa (JP); Yosuke Kitagawa, Kanagawa (JP); Hideaki Nagahara, Kanagawa (JP); Yasushi Ishida, Tokyo (JP); Toshiya Matsumoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 257 days.

(21) Appl. No.: 17/870,665

(22) Filed: Jul. 21, 2022

(65) Prior Publication Data

US 2023/0058937 A1 Feb. 23, 2023

(30) Foreign Application Priority Data

Aug. 18, 2021 (JP) ..... 2021-133674

(51) Int. Cl.

| | |
|---|---|
| ***B65H 29/52*** | (2006.01) |
| ***B65H 1/04*** | (2006.01) |
| ***B65H 1/26*** | (2006.01) |
| ***B65H 29/04*** | (2006.01) |

(52) U.S. Cl.

CPC ..... *B65H 29/52* (2013.01); *B65H 1/04* (2013.01); *B65H 1/266* (2013.01); *B65H 29/041* (2013.01); *B65H 2405/1124* (2013.01); *B65H 2511/11* (2013.01); *B65H 2801/06* (2013.01); *B65H 2801/12* (2013.01); *B65H 2801/15* (2013.01)

(58) Field of Classification Search

CPC ..... B65H 2405/11162; B65H 2045/11163; B65H 2045/111643; B65H 2405/111646; B65H 2405/1117; B65H 2405/11171; B65H 2405/11172; B65H 2405/1124; B65H 2405/1134; B65H 2405/1142; B65H 2405/1144; B65H 31/20

See application file for complete search history.

(56) References Cited

U.S. PATENT DOCUMENTS

| | | | | |
|---|---|---|---|---|
| 8,424,871 | B2 * | 4/2013 | Ino | B65H 31/20 271/223 |
| 10,958,806 | B2 | 3/2021 | Ishihara et al. | H04N 1/10 |
| 11,345,172 | B2 | 5/2022 | Saito et al. | B41J 13/10 |

FOREIGN PATENT DOCUMENTS

| | | |
|---|---|---|
| JP | H04-236809 | 8/1992 |
| JP | H11-082471 | 3/1999 |

OTHER PUBLICATIONS

U.S. Appl. No. 17/862,314, filed Jul. 11, 2022.

* cited by examiner

*Primary Examiner* — Jeremy R Severson
(74) *Attorney, Agent, or Firm* — Venable LLP

(57) ABSTRACT

A cassette comprises a storage portion configured to include a loading surface on which a sheet is loaded, a sheet guide configured to pivot with respect to a pivot central axis that is parallel to the loading surface, a pivot support shaft extending on two sides of the sheet guide along the pivot central axis, in the sheet guide, and a bearing portion configured to pivotably support the pivot support shaft, an insertion portion formed at a portion of the pivot support shaft, an insertion groove formed from the loading surface toward the bearing portion, and a flexible pressing portion disposed outside the insertion groove, and configured to press a leading end portion of the pivot support shaft.

14 Claims, 15 Drawing Sheets

CASSETTE AND PRINTING APPARATUS

BACKGROUND OF THE INVENTION

Field of the Invention

The present invention relates to a sheet feed cassette that is used in a printer and the like.

Description of the Related Art

In recent years, as opportunities to use home printers has increased, there has been a desire to load a large volume of paper in a printer, and there are a large number of printers capable of feeding sheets from not only an automatic sheet feeder (hereinafter, ASF), but also a sheet feed cassette (hereinafter, a "cassette") as a sheet feed mechanism. In a cassette that is loaded with a paper bundle and is detachable from a printer body, a paper guide for aligning paper with a setting position is provided such that various sizes of paper can be accurately set. Usually, when the sheet feed direction of paper loaded in the cassette is defined to be a forward direction, the paper guide guides the two side portions and the trailing edge of the paper. Accordingly, consideration has been given to prevent the position of paper from being displaced during a sheet feed operation.

Here, an end guide for positioning and holding the trailing edge of paper is detachable or slidable in accordance with a paper size, in order to support various sizes of paper. In particular, a slidable end guide can support various paper sizes, and is thus convenient, but requires a rail structure that enables the end guide to slide, and a fixing function for preventing displacement during sheet feeding using a latch, friction rubber, or the like.

On the other hand, there are cases where, depending on a cassette, a guide function for supporting various paper sizes is not necessary as a result of limiting paper sizes that are mainly used, mounting a plurality of cassettes and setting and using the cassettes respectively for paper sizes, and the like. In this case, instead of a slidable end guide that has a complicated structure and requires a space, a tiltable end guide may be used. If the end guide is tiltable in this manner, a space for the guide when it is tilted can be eliminated, which is very advantageous for reducing the size of the cassette.

As an aspect of a conventional tiltable end guide, a cassette 200 that has a tiltable end guide 220 as shown in FIGS. 16, 17A, and 17B is known. In the structure of this cassette, the end guide 220 is provided with a pivot support shaft that serves as a pivot center when the end guide is tilted, and a bearing portion 210 that pivotally supports the aforementioned pivot support shaft is provided below a loading surface of the cassette to be loaded with paper. During assembly, the bearing portion 210 is bent and spread, and a pivot shaft and a bearing hole engage with each other for assembly. Therefore, the bearing portion 210 is likely to bend due to its structure, and the bearing portion 210 may bend when a load is applied to the end guide 220.*z*

As an ordinary shaft support structure of such a structural object that pivots, there is also a known structure in which a portion or the entirety of a shaft support portion is flexible for easy assembly as with Japanese Patent Laid-Open No. 4-236809. In addition, there is also a known structure in which a notch is provided at a portion of a hole to create a notch hole, for easy assembly, as with Japanese Patent Laid-Open No. 11-82471.

However, using a tiltable end guide as described above is advantageous for reducing the size and the thickness of the cassette, but a nearby installation space is reduced due to a reduction in the size, and the strength of a mechanism for pivotably supporting the end guide is reduced. Furthermore, there are cases where, in a structure in which a shaft support portion is flexible for easy assembly, the shaft support portion bends and an end guide comes off if operated with excessive force or dropped by the user, for example. On the other hand, if the strength is increased and the shaft support portion is made difficult to bend, the assemblability decreases.

In addition, in the structure of a pivot shaft that has a notch hole, there has been a problem in that an end guide is likely to come off depending on the posture of the end guide as a matter of course.

SUMMARY OF THE INVENTION

The present invention has been made in light of the above-described problem, and suppresses a decrease in the assemblability of a tiltable end guide in a sheet feed cassette.

According to a first aspect of the present invention, there is provided a cassette comprising: a storage portion configured to include a loading surface on which a sheet is loaded; a sheet guide configured to pivot with respect to a pivot central axis that is parallel to the loading surface, and to be capable of switching between an accommodated state where the sheet guide is parallel to the loading surface and an erect state for guiding a sheet where the sheet guide is erect from the loading surface; a pivot support shaft extending on two sides of the sheet guide along the pivot central axis, in the sheet guide, and a bearing portion configured to pivotably support the pivot support shaft, in the storage portion; an insertion portion formed at a portion of the pivot support shaft, and configured to have a smaller width than a diameter of the pivot support shaft; an insertion groove formed from the loading surface toward the bearing portion, and has a smaller width than the diameter of the pivot support shaft; and a flexible pressing portion disposed outside the insertion groove, and configured to press a leading end portion of the pivot support shaft.

According to a second aspect of the present invention, there is provided a printing apparatus in which it is possible to mount the cassette described above.

Further features of the present invention will become apparent from the following description of exemplary embodiments with reference to the attached drawings.

DESCRIPTION OF THE EMBODIMENTS

Figure 1:
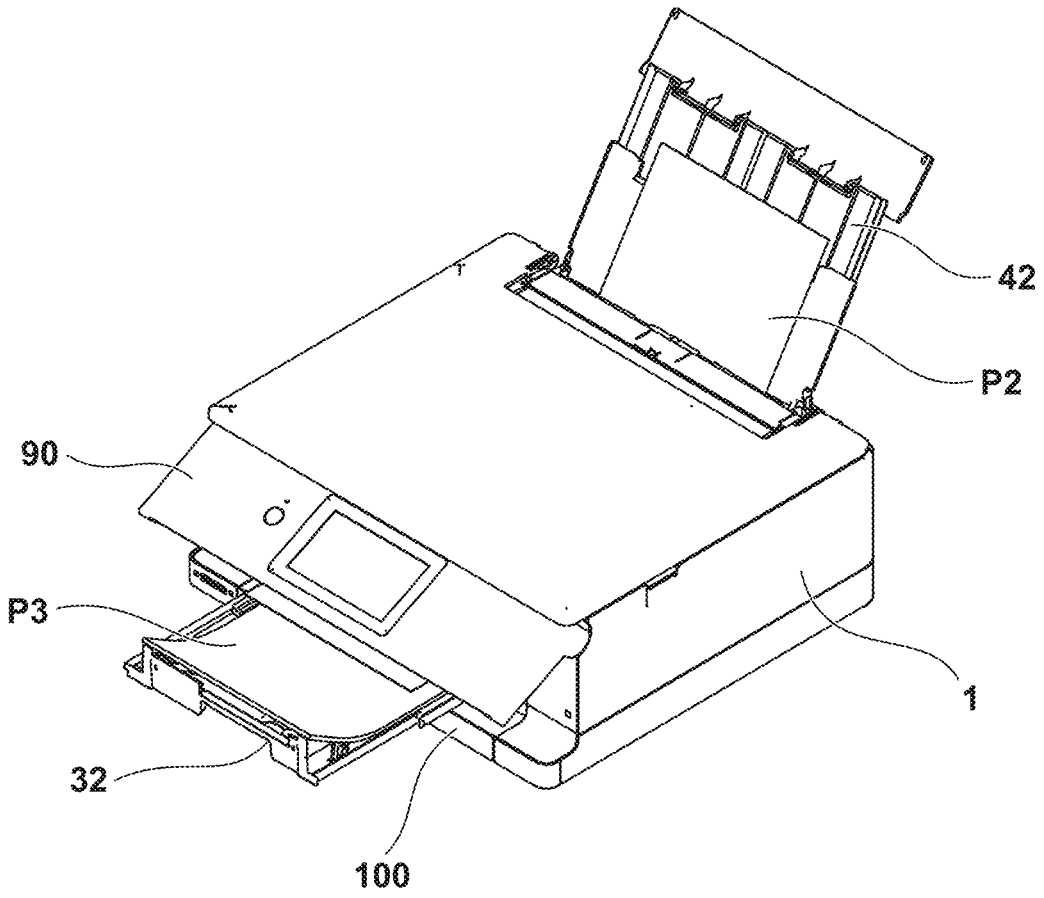
FIG. 1 is a perspective view of an inkjet printing apparatus in which a sheet feed cassette according to an embodiment of the present invention is mounted.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

Overall Configuration of Inkjet Printing Apparatus

Figure 2:
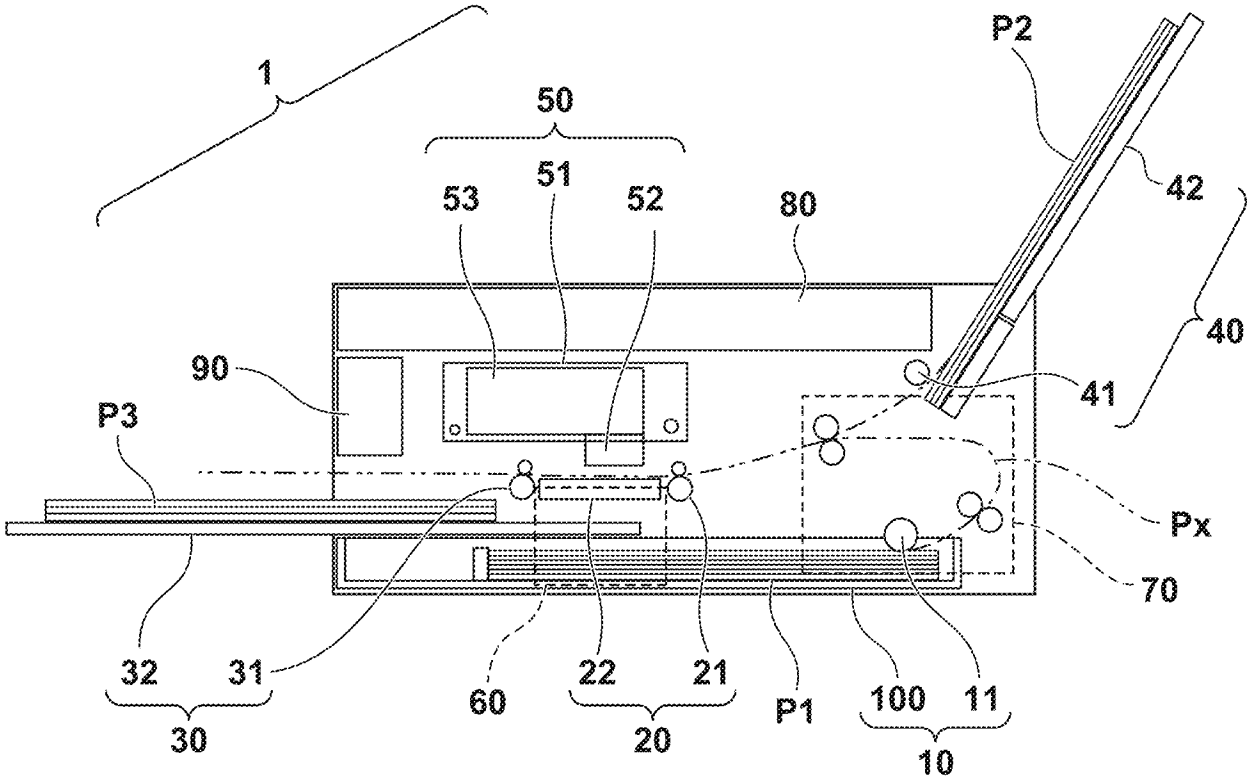
FIG. 2 is a cross-sectional view of the inkjet printing apparatus.

FIG. 1 is a perspective view of an inkjet printing apparatus in which a sheet feed cassette according to an embodiment of the present invention is mounted. FIG. 2 is a cross-sectional view showing a paper path of the inkjet printing apparatus in FIG. 1.

In FIGS. 1 and 2, a cassette sheet feed unit 10 is disposed to be mountable on the lower side of an apparatus body 1. The cassette sheet feed unit 10 includes a sheet feed cassette (hereinafter, a "cassette") 100 that is loaded with a paper bundle P1 of a plurality of pieces of paper (sheets) for performing recording, and a sheet feed roller 11 that feeds paper from the paper bundle P1 one sheet at a time. The cassette (paper storage portion) 100 is configured to be detachable from the apparatus body 1 from the front side thereof (left side in the figure), and the sheet feed roller 11 is disposed on the rear side of the cassette sheet feed unit 10.

A conveyance unit 20 has a function of conveying paper at a position where recording (printing) is performed onto the paper, and includes a pair of conveyance rollers 21 that convey paper, and a platen 22 that supports paper.

A sheet discharge unit 30 has a function of discharging paper that has undergone recording, and includes a pair of sheet discharge rollers 31 for discharging paper and a sheet discharge tray 32 on which discharged paper is loaded.

An ASF (automatic sheet feeder) unit 40 is provided on the rear side of the apparatus body 1, and feeds paper in order to record an image onto a piece of paper other than the paper in the cassette sheet feed unit 10. The ASF unit 40 can be loaded with a paper bundle P2, and includes an openable/closable and extensible sheet feed tray 42. An ASF roller 41 that feeds paper from the paper bundle P2 one sheet at a time is provided on the lower side of the sheet feed tray 42.

Reference sign Px indicates a paper path along which paper travels from the sheet feed units to the sheet discharge unit, and a pair of rollers (not illustrated), a paper path guide (not illustrated), and the like are disposed between units, forming a conveyance path of paper.

A carriage unit 50 includes a recording head 52 for discharging ink onto conveyed paper, and a carriage 51 to which the recording head 52 is fixed, and reciprocally moves in the main scanning direction to perform recording. A plurality of ink tanks 53 that respectively contain a plurality of colors of ink are mounted in the carriage 51, and, as a result of ink being discharged from nozzles of a plurality of colors provided in the recording head 52, color printing can be performed. When ink of C (cyan) color, M (magenta) color, Y (yellow) color, and K (black) color is discharged from the recording head 52, for example, full-color printing can be performed. When the recording head 52 is not performing recording, the carriage 51 is back and waiting at a home position provided at a predetermined position in a reciprocal movement range.

A recovering unit 60 has a function of recovering discharge of the recording head 52. The recovering unit 60 includes, at a position opposed to the recording head 52 returned to the home position, a cap that covers the nozzle surface of the recording head 52, performs suction recovery for resolving clogging of a nozzle of the recording head 52, and protects the nozzles.

An electric control unit 70 includes a power supply, a control substrate, and the like, and controls an operation of conveying paper using the sheet feed rollers 11 and 41 of the sheet feed units, the pair of conveyance rollers 21, and the pair of sheet discharge rollers 31. The electric control unit 70 is also connected to the recording head 52 by an electric connecting means such as an FFC or a cable for transmitting power and a discharge control signal. The electric connecting means is configured to be reciprocally movable along with the recording head 52, accompanying reciprocal movement of the carriage 51.

A reading unit 80 has a document reading function, and the inkjet printing apparatus can perform not only recording but also reading. An operation panel 90 is used for performing operations on the apparatus body 1, and displays the state of the apparatus body 1.

Basic Operations of Inkjet Printing Apparatus

Next, operations of the inkjet printing apparatus according to the present embodiment will be described.

When a recording instruction is input to the apparatus body 1, the cap that has protected the recording head 52 separates from the recording head 52, and the recording head 52 is ready to perform recording.

When paper that is a recording target is in the cassette sheet feed unit 10, the sheet feed roller 11 of the cassette sheet feed unit 10 is driven, and paper is fed from the paper bundle P1 loaded in the cassette 100 one sheet at a time. The fed paper is conveyed toward the conveyance unit 20 along the paper path Px. The paper is further sandwiched between the pair of conveyance rollers 21, and is conveyed to the upper side of the platen 22 (recording position) disposed at a position opposing the recording head 52.

When the paper is conveyed to the recording position, the recording head 52 mounted to the carriage 51 reciprocally moves in the main scanning direction, ink is discharged toward paper that is passing through the platen 22, and an image is recorded on the paper. The paper is further conveyed to the sheet discharge tray 32 along the paper path Px by the pair of sheet discharge rollers 31 of the sheet discharge unit 30. When recording is performed on a plurality of sheets in a continuous manner, paper subjected to recording is stacked as a paper bundle P3 on the sheet discharge tray 32.

When recording is complete, the carriage 51 returns to and stops at the home position at which the recording head 52 can be capped, and a recovering operation of the recording head 52 is performed.

On the other hand, when paper that is a recording target is in the ASF unit 40, the sheet feed roller 41 of the ASF unit 40 is driven, and paper is fed one sheet at a time from the paper bundle P2 loaded in the sheet feed tray 42. The fed paper is conveyed toward the conveyance unit 20 along the paper path Px constituted by a pair of rollers and a path guide, and an image is recorded onto the paper similarly to the above-described case of sheets fed from the cassette 100.

In sheet feeding from the ASF unit 40, since the route of the paper path is relatively straight and short, and the sheet feed tray 42 that is openable/closable or extensible is provided, it is easy to replace and load paper, and various types of paper can be loaded and fed. Some commercially available printing apparatuses can support a wide variety of paper sizes including A2 size and business card size, for example. In addition, there is no limitation to plain paper, and some printing apparatuses can support various types of paper onto which an image can be recorded by an inkjet printing apparatus in an ordinary manner, such as gloss paper and film paper.

Note that, when loading the paper bundle P1 in the cassette 100, since the cassette 100 can be installed on the lower side of the apparatus body 1, it is possible to increase the capacity of paper that is loaded and the number of stages, which is suitable for mass printing. In general, paper that is frequently used is loaded in the cassette 100 in most cases, and it is also possible to constantly load the paper bundle P1 of a specific size such as A4.

Configuration of Cassette

Next, the configuration of the cassette 100 according to the present embodiment will be described.

Figure 3:
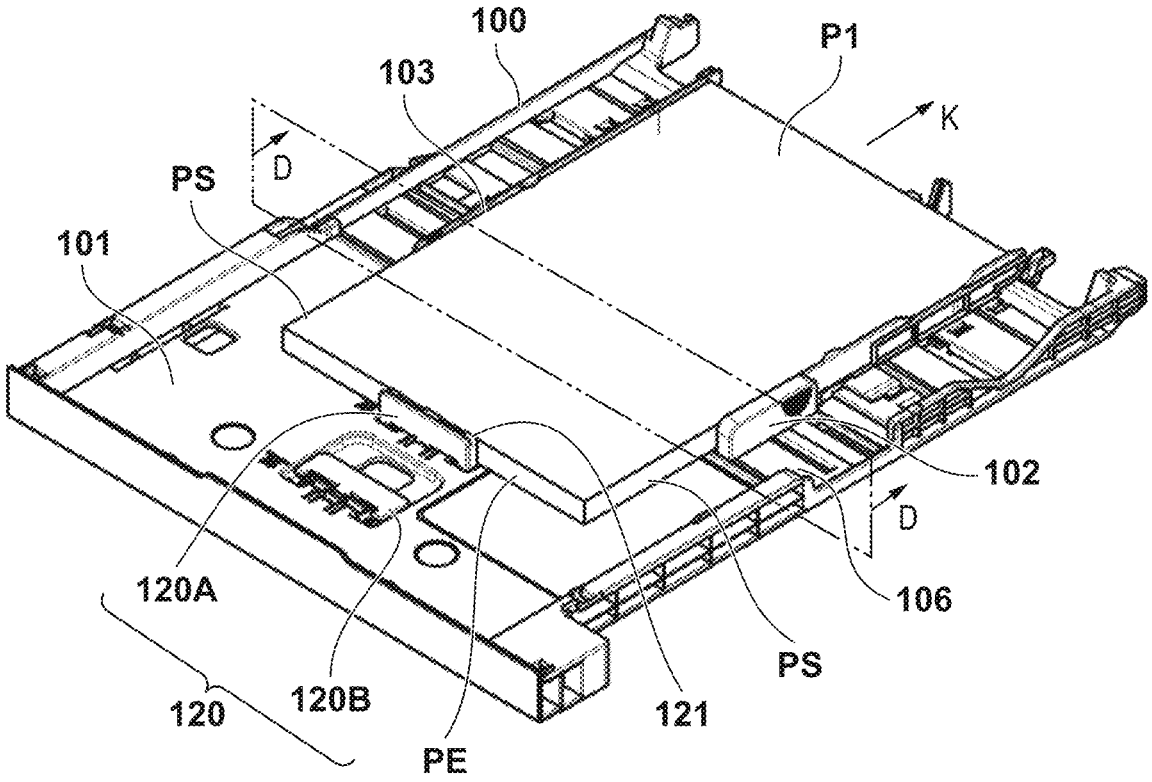
FIG. 3 is a perspective view of a cassette when loaded with A5-size paper.

FIG. 3 is a perspective view of the cassette 100 (cassette body) when removed from the apparatus body 1, and loaded with a paper bundle P1 of A5-size paper.

The direction of an arrow K toward a farther side of the cassette 100 in FIG. 3 is a sheet feed direction of paper, and the paper bundle P1 is loaded at about the center of a loading surface 101 of the cassette 100. Side guides 102 and 103 for guiding side end surfaces PS of the paper bundle P1 when the paper bundle P1 is loaded are provided in the cassette 100. In the present embodiment, a configuration is adopted in which a conveyance reference is set to the center of a paper width such that the two side guides 102 and 103 on the two sides thereof undergo gear interlocking, and can slide on a slide surface 106 by the same distance from the center. The side guides 102 and 103 are slid and positioned at the equal distances on the right and left sides in accordance with the width of paper, and thus the center of paper can be aligned with the center of a paper path surface Px of the apparatus body 1.

Figure 4A:
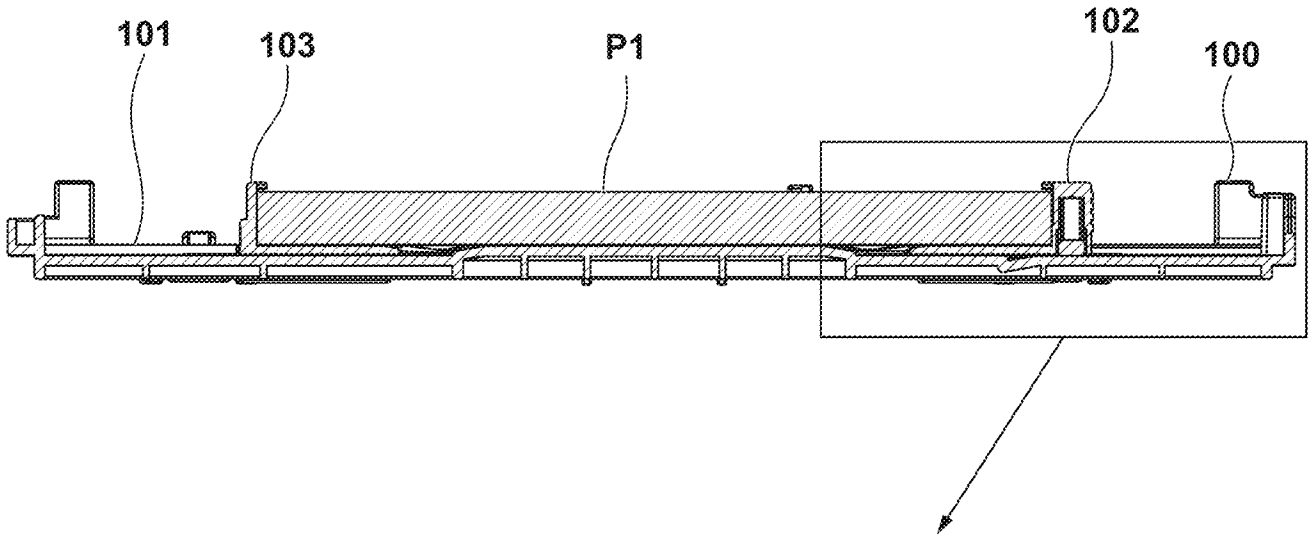
FIGS. 4A and 4B are a cross-sectional view of a side guide of the cassette and a detail view of a portion thereof.
Figure 4B:
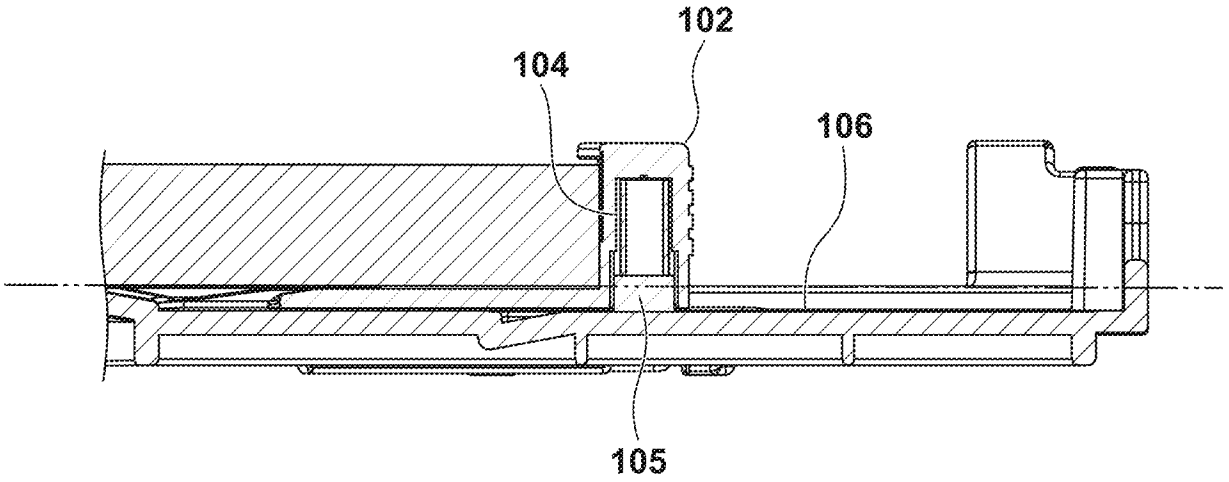

FIG. 4A is a cross-sectional view when viewed in a direction indicated by D arrows in the cassette 100 in FIG. 3, and FIG. 4B is a detail view of a portion thereof when enlarged.

In FIGS. 4A and 4B, a friction rubber 105 is provided inside the wall of one of the side guides, namely the side guide 102, and is biased so as to press against the slide surface 106 of the cassette 100 using a spring 104. Accordingly, the side guide 102 is unlikely to move from the position to which paper has been guided. Note that the side guide 102 may be fixed using a click or the like, in place of the friction rubber 105.

On the other hand, as shown in FIG. 3, a plurality of end guides (sheet guides) 120 for guiding a trailing edge surface PE (paper end) of the paper bundle P1 are also provided in a trailing edge portion of the paper bundle P1. In the present embodiment, two end guides 120A and 120B are provided for A5 and B5 paper sizes. It is possible to erect an end guide 120 that corresponds to the size of paper, and guide the paper. It is also possible to accommodate an end guide 120 that is not in use, below the loading surface 101 of the cassette 100. In order to prevent the occurrence of a sheet feed failure, each end guide 120 needs to engage such that the paper bundle P1 to be fed does not move in a direction opposite to the sheet direction K. Therefore, a configuration is adopted in which the end guide 120 is erected from the feeding direction in the opposite direction to the sheet feed direction, and, in this state, a guide surface 121 that abuts against the trailing edge surface PE of the paper bundle P1 can hold the posture without tilting.

In an operation of loading the paper bundle P1 in the cassette 100, the side guides 102 and 103 are moved away from each other for a distance wider than the width of paper to be loaded, and an end guide 120 at the position corresponding to the paper size is erected. The trailing edge surface PE of the paper bundle P1 abuts against the guide surface 121 of the end guide 120, and the side guides 102 and 103 are then slid to the side end surfaces PS of the paper bundle P1 so as to position the paper bundle P1.

As described above, when the paper bundle P1 of A5-size paper is loaded, the end guide 120A for A5-size paper is erected, the trailing edge surface PE of the paper bundle P1 is aligned with the end guide 120A, and the paper bundle P1 is loaded in the cassette. Furthermore, as a result of moving the side guides 102 and 103 and guiding the two side surfaces of paper bundle, A5-size paper can be loaded at an appropriate position in the cassette.

Figure 5:
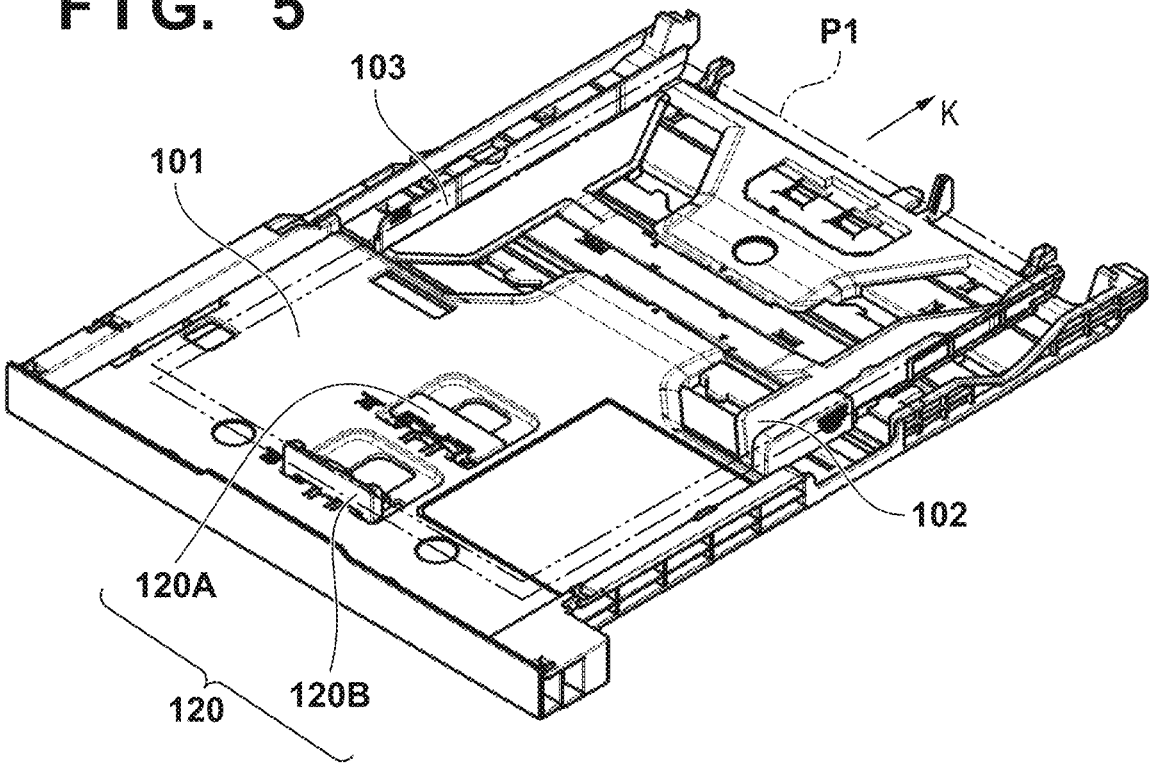
FIG. 5 is a perspective view of the cassette when loaded with B5-size paper.

On the other hand, when loading the paper bundle P1 of B5-size paper (indicated by the dashed double-dotted line in FIG. 5), the end guide 120A for A5-size paper is accommodated and the end guide 120B for B5-side paper is erected as shown in FIG. 5. Accordingly, it is possible to guide the trailing edge surface PE of the paper bundle P1 of B5-size paper.

Figure 6:
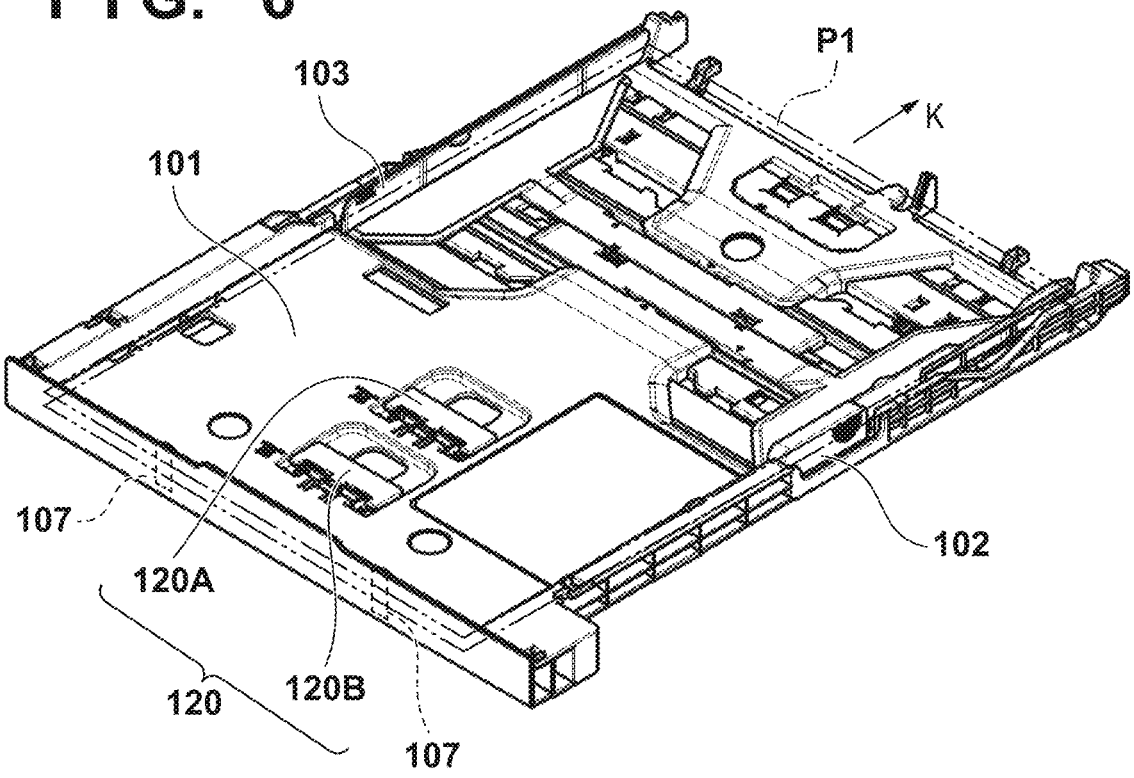
FIG. 6 is a perspective view of the cassette when loaded with A4-size paper.

In addition, it is possible to load the paper bundle P1 of A4-size paper that is larger than the B5-size paper (indicated by the dashed double-dotted line in FIG. 6) by accommodating the two end guides 120A and 120B together as shown in FIG. 6. In this case, as a trailing edge guide of the largest loading size, libs 107 are provided on the furthest trailing edge side in the cassette 100, and the libs 107 serve as guide surfaces and abut on the paper. Accordingly, it is possible to guide the trailing edge of A4-size paper bundle.

As described above, by loading the paper bundle P1 of each size to come into contact with the guide surface of a corresponding end guide, the paper bundle P1 can be loaded at a proper position. In addition, even if a large amount of paper is loaded and used continuously, the guide does not move, and paper can be constantly fed from a proper position.

Configuration of End Guide

Figure 7:
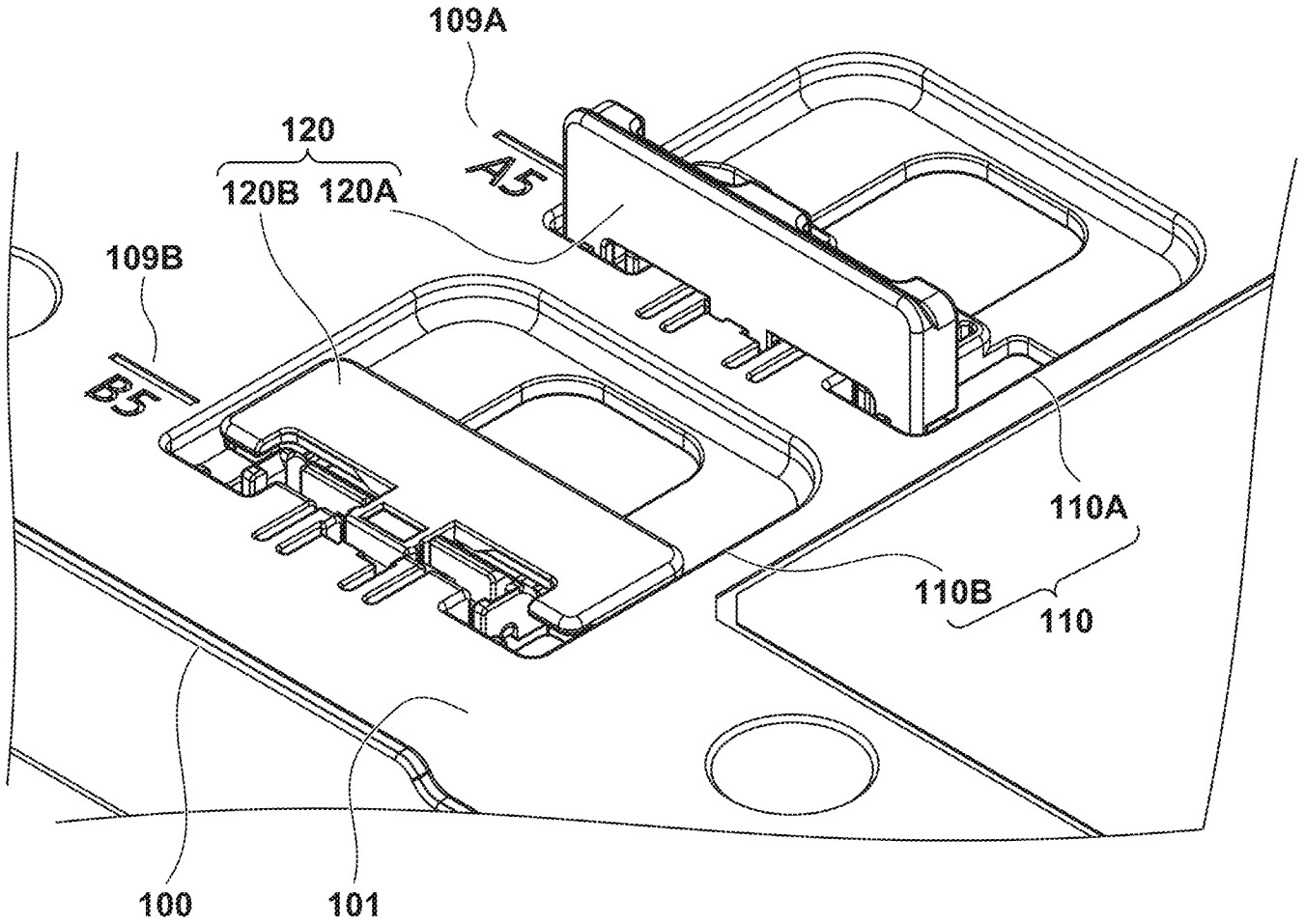
FIG. 7 is a detail view of end guides of the cassette.

FIG. 7 is a diagram showing a detailed configuration of the end guides 120 of the cassette 100 according to the present embodiment.

As described above, the end guides 120 are disposed to be pivotable at predetermined positions in the cassette 100 so as to be able to be erected and accommodated in accordance with the size of the paper bundle P1 to be loaded. Attachment portions 110 of the end guides 120 are provided such that an erected end guide 120 is positioned at the trailing edge position of the paper bundle P1. A plurality of attachment portions 110 can be installed depending on the size of paper to be used, and, in the present embodiment, two attachment portions 110A and 110B are provided. Indexes 109A and 109B for indicating respective paper sizes to be used are provided in the vicinity of the attachment portions 110A and 110B.

Figure 8:
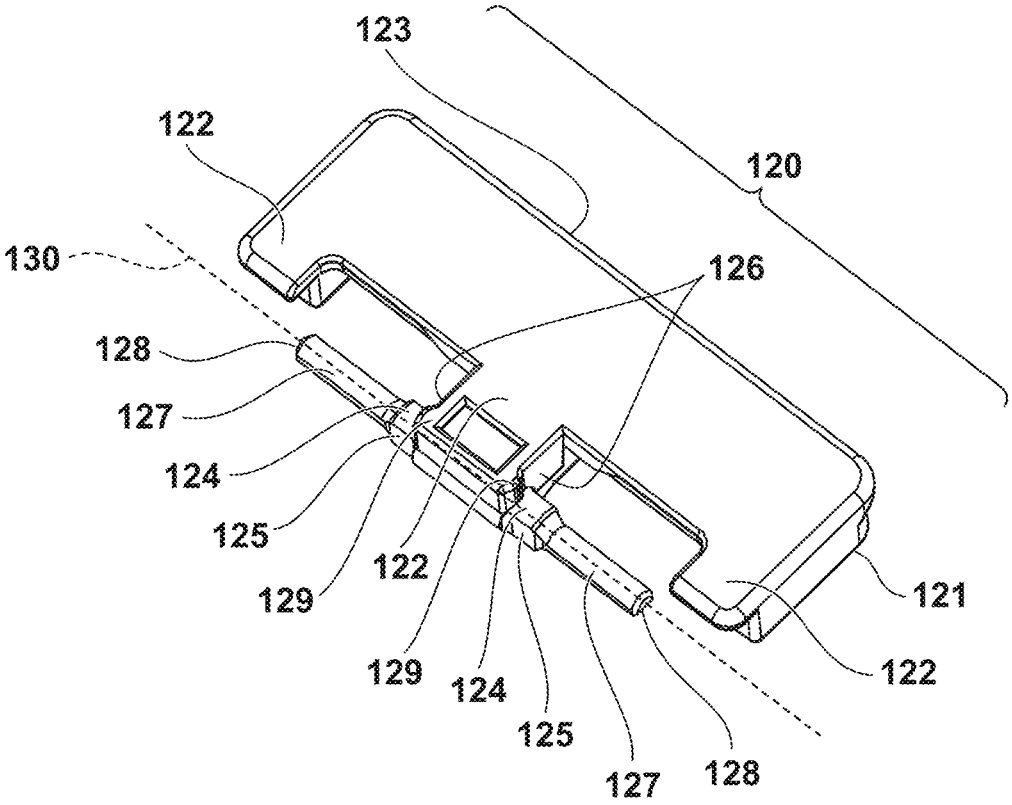
FIG. 8 is a detail view of components of an end guide.

FIG. 8 is a diagram showing a detail structure of a single end guide 120 that pivots.

The end guide 120 includes a guide portion that abuts against the trailing edge portion of paper and a pivot support portion that enables the end guide 120 to pivot.

The guide portion includes the guide surface 121 that abuts on the trailing edge surface PE of the paper bundle P1, and the guide surface 121 serves as a surface substantially vertical to the loading surface 101 when the end guide 120 is erected from the cassette 100. Also, the guide portion is configured such that, when the end guide 120 is erected, abutting portions 122 abut on the cassette 100, in order to maintain the posture thereof.

In the pivot support portion, two pivot support shafts 124 are formed on the two sides along a pivoting central axis 130. An insertion surface portion 125 consisting of surfaces in the same phase is provided in a portion of each of the two pivot support shafts 124. The insertion surface portion (insertion portion) 125 consists of surfaces perpendicular to the guide surface 121 of the end guide 120. Here, furthermore, the insertion surface portions 125 are provided on opposite sides at symmetric positions on the pivot support shafts 124, forming opposing cut surfaces. Slide surfaces 126 for suppressing thrust play of the end guide 120 are provided in the vicinity of the bases of the pivot support shafts 124, and the slide surfaces 126 slide on the cassette 100 side such that the end guide 120 smoothly pivots.

In addition, first inclined surfaces 128 having a chamfered shape are provided at the leading portions of the two pivot support shafts 124. In the present embodiment, link portions 131 (see FIG. 9) that reinforce the cassette are provided in order to increase the rigidity of the cassette while reducing the thickness of the cassette 100. Therefore, extending shafts 127 having a smaller diameter than the pivot support shafts 124 are formed on the farther leading end sides of the pivot support shafts 124 in order to secure a space, and the first inclined surfaces 128 having a chamfered shape are provided on the leading ends of the extending shafts 127.

Figure 9:
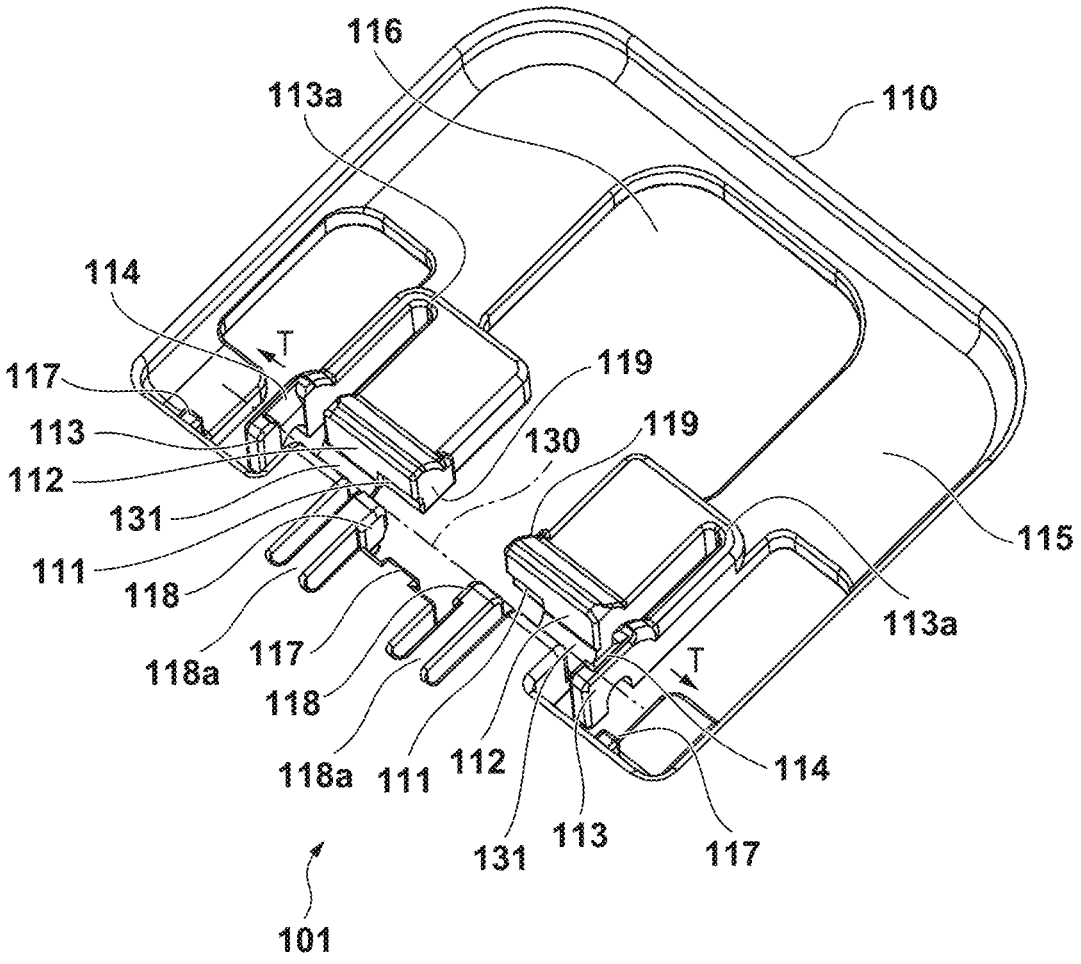
FIG. 9 is a detail view showing a structure on the cassette side in which an end guide is incorporated.

FIG. 9 is a diagram showing a detailed structure of the attachment portion 110 on the cassette 100 side for attaching the end guide 120.

Bearing portions 111 are provided symmetrically with respect to the center of the end guide 120 along the pivoting central axis 130 of the end guide 120, and an insertion groove 112 is provided between each of the bearing portions 111 and the loading surface 101 such that the insertion surface portions 125 of the end guide 120 can be inserted.

Slide surfaces 119 that respectively slide on the slide surfaces 126 of the end guide 120 and support the end guide 120 to prevent it from moving in a thrust direction are provided on the inner surfaces of the bearing portions 111.

On the outer sides of the bearing portions 111, the link portions 131 that reinforce the attachment portion 110 on the cassette 100 side are provided in spaces formed due to the extending shafts 127 of the end guide 120 being tapered. In addition, retainers 113 that are engaged with the leading end portions of the extending shafts 127 of the end guide 120 are provided on the outer sides relative to the link portion 131. These retainers 113 are formed integrally with the cassette 100, into an arm-like shape in which a base portion 113A serves as a support point, are flexible, and include second inclined surfaces 114 at positions abutting against the first inclined surfaces 128 of the leading ends of the extending shafts 127 of the end guide. When the end guide 120 is assembled, as a result of the first inclined surfaces 128 respectively abutting against the second inclined surfaces 114, the retainers 113 are pressed to move away from each other to the outer sides of the end guide 120 as indicated by arrows T, and the end guide 120 can then be incorporated.

In the cassette 100 near the end guide 120, a housing space 115 is provided to prevent the end guide 120 from protruding from the loading surface 101 when it is tilted. A finger placement hole (recess portion) 116 is provided in the housing space 115 such that a user's finger is placed on a finger placement portion 123 of the end guide 120 and an erecting operation is easily performed.

In addition, click protrusion portions 129 are formed near the slide surfaces 126 of the end guide 120, and flexible portions (engaging portions) 118 are provided near the slide surfaces 119 of the cassette 100. Each flexible portion 118 is configured to bend using a base portion 118A as a support point. As a result of the click protrusion portions 129 of the end guide 120 coming into contact with and moving over the click flexible portions 118 of the cassette 100 at partway along the pivot path of the end guide 120, a click feeling is provided, whereby consideration is given such that inadvertent pivot will not occur.

Attachment of End Guide

Next, an attachment procedure of the end guide according to the present embodiment will be described.

Figure 10:
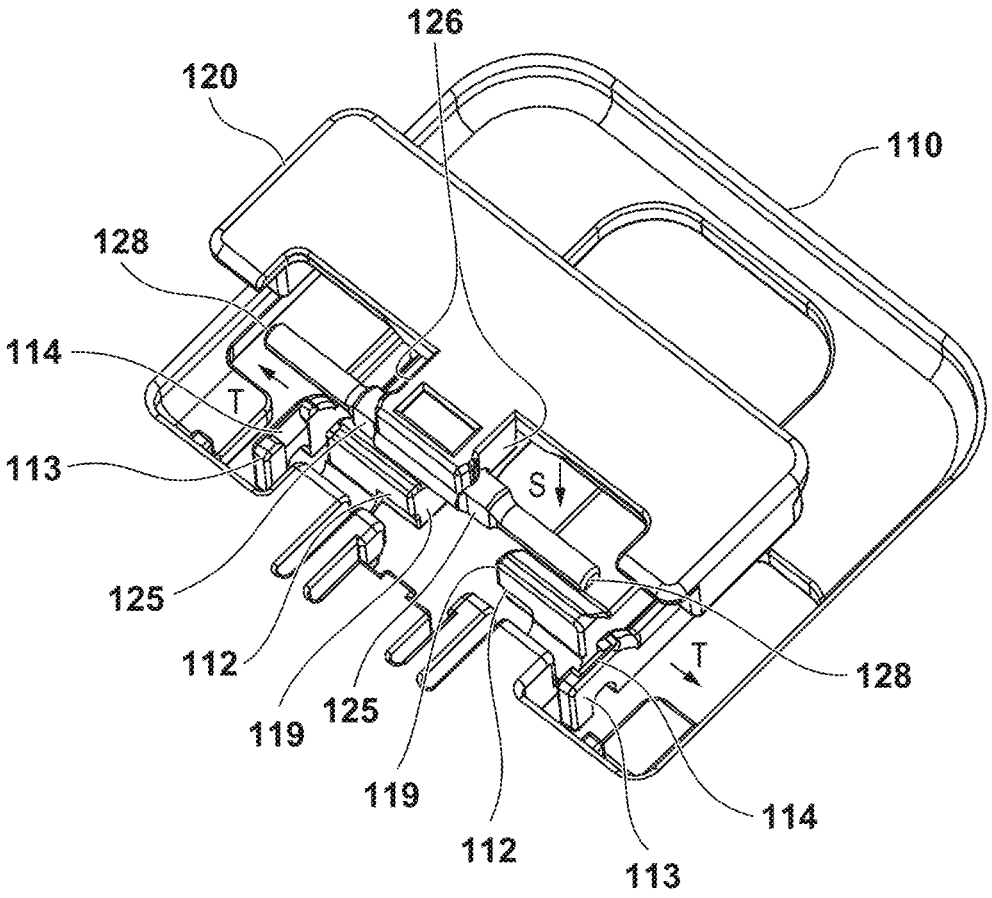
FIG. 10 is a perspective view of an end guide during assembly.
Figure 11A:
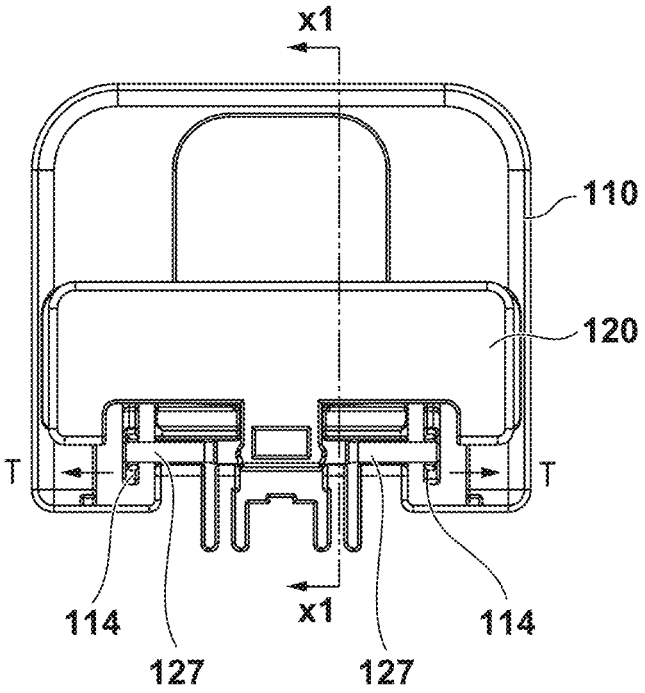
FIGS. 11A and 11B are a plan view and a cross-sectional view of an end guide during assembly.

FIG. 10 is a perspective view of the end guide 120 before being attached to the attachment portion 110 of the cassette 100. FIG. 11A is a plan view of FIG. 10, and FIG. 11B is a cross-sectional view when viewed in a direction indicated by ×1 arrows in FIG. 11A.

Figure 11B:
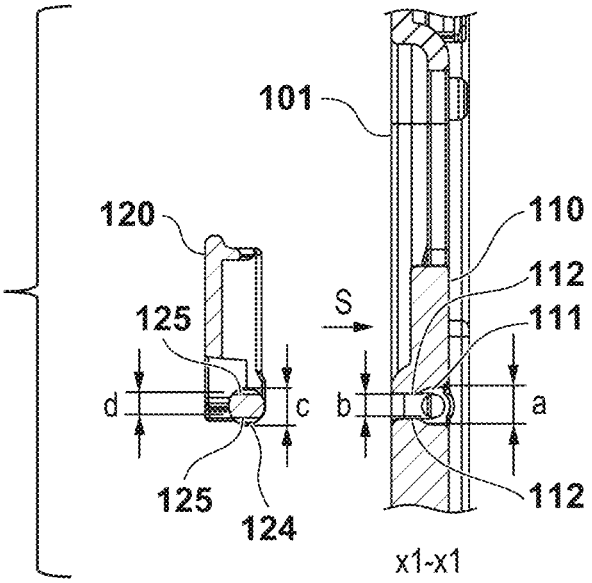

Note that, as shown in FIGS. 11A and 11B, a gap width b of each of the insertion grooves 112 of the cassette 100 is smaller than a diameter c of the pivot support shaft 124 of the end guide and a diameter a of the bearing portion 111 of the cassette, and is slightly larger than a thickness d of the insertion surface portion 125 of the end guide 120. In addition, the diameter c of the pivot support shaft 124 of the end guide 120 and the diameter a of the bearing portion of the cassette 100 have dimensions to be fitted to each other, and the diameter a of the bearing portion 111 of the cassette 100 is slightly larger. The size relation is expressed by the following inequality:

$$\text{diameter(bearing portion)}a > \text{diameter(pivot support axis)}c >> \text{gap width}B > \text{thickness}d$$

If the posture of the end guide 120 is changed to a posture in which the end guide 120 is accommodated on the loading surface 101 of the cassette 100 (the guide surface 121 is parallel to the loading surface 101), the angle of each insertion surface portion 125 of the end guide and the angle of the corresponding insertion groove 112 of the cassette match. The thickness d of the insertion surface portion 125 is smaller than the gap width b of the insertion groove 112, and thus, by lowering the end guide 120 substantially at a right angle (an arrow S direction) to the loading surface 101 in this posture, the pivot support shaft 124 of the end guide move through the insertion groove 112, and proceeds in to the bearing portion 111.

At this time, the first inclined surfaces 128 of the leading ends of the extending shafts 127 of the end guide 120 abut against the second inclined surfaces 114 of the retainers 113 of the cassette 100, and the end guide 120 is attached while moving the retainers 113 away from each other (in the arrow T direction). When the attachment ends, the retainers 113 return to the original positions, pressing the two ends of the extending shafts 127 of the end guide 120 in the insertion direction to prevent them from returning, which ensures that the end guide 120 will not come off.

In addition, the slide surfaces 126 of the end guide 120 and the slide surfaces 119 of the cassette 100 are attached in an engagement state where there is little thrust play, and the end guide 120 is pivotably incorporated in the cassette 100 while the position thereof is regulated in a direction extending along the pivoting central axis 130.

Figure 12:
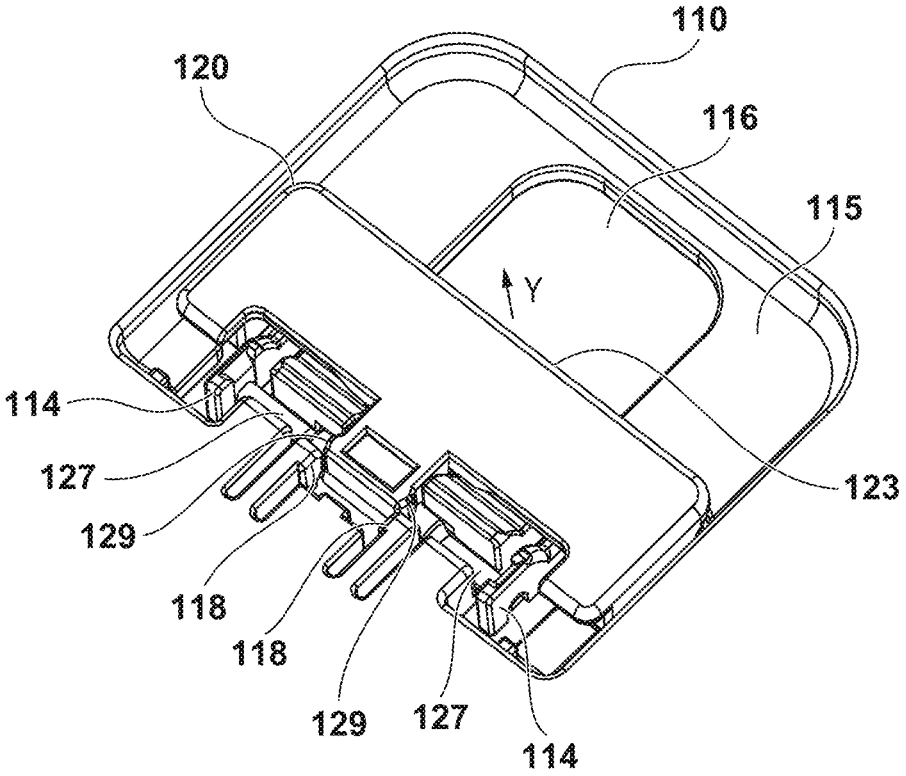
FIG. 12 is a perspective view of an end guide in an accommodated state.
Figure 13A:
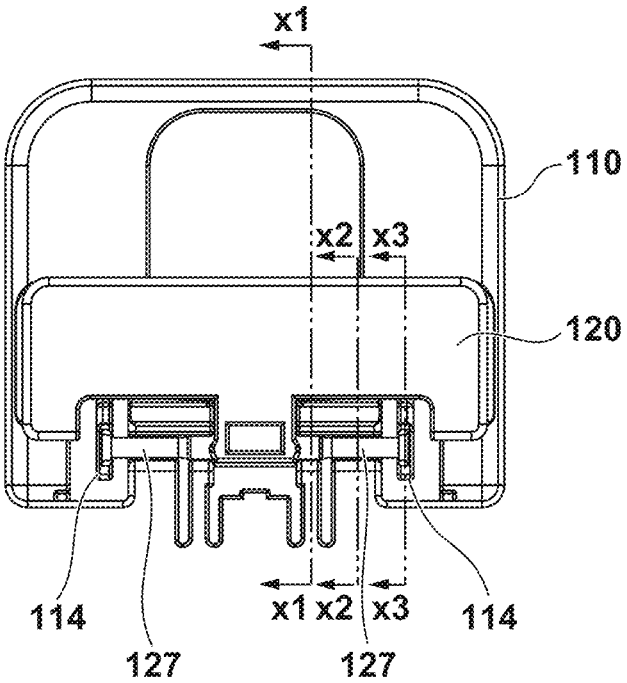
FIGS. 13A to 13D are a plan view and a cross-sectional views of an end guide in an accommodated state.
Figure 13B:
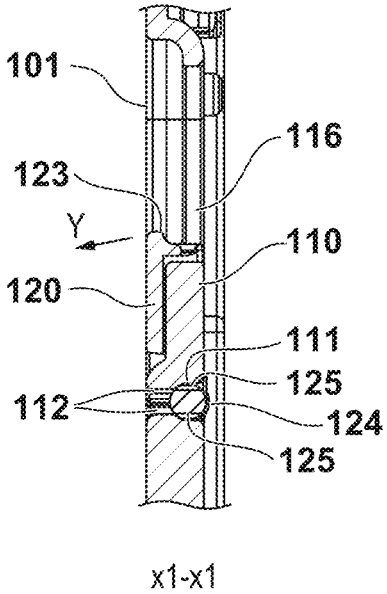
Figure 13C:
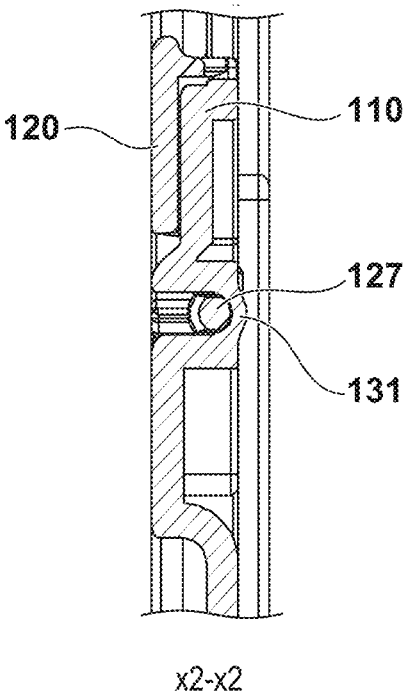
Figure 13D:
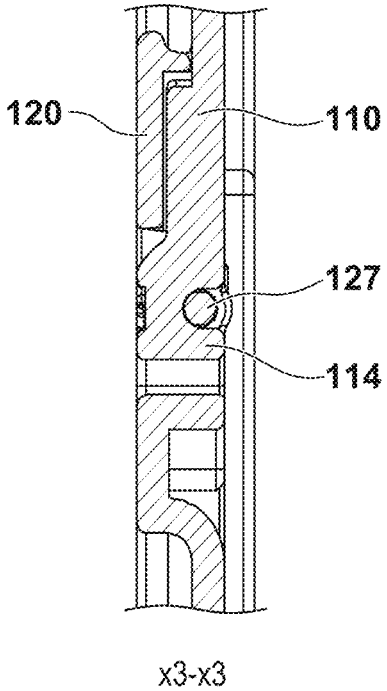

FIG. 12 is a perspective view of a state where the end guide 120 is incorporated in the cassette 100. FIG. 13A is a plan view of FIG. 12, and FIGS. 13B to 13D are respectively a cross-sectional view when viewed in a direction indicated by ×1 arrows in FIG. 11A, a cross-sectional view when viewed in a direction indicated by ×2 arrows, and a cross-sectional view when viewed in a direction indicated by ×3 arrows.

In the state in FIG. 12, the end guide 120 is incorporated in the housing space 115 of the cassette 100. In addition, in this state, the end guide 120 is supported by the bearing portions 111 of the cassette 100 and the slide surfaces 126 against a load acting in an assembly insertion direction (the arrow S direction in FIG. 10), or a direction perpendicular to the insertion direction, and thus the end guide 120 is unlikely to be detached. Note that the end guide 120 can be easily detached by moving the flexible retainers 113 away from each other in the arrow T direction from this state, and pressing and returning the end guide 120 from the rear side of the cassette 100. A paper loading operation is hardly performed from the rear side of the cassette 100, and thus it is possible to keep the end guide 120 from being inadvertently detached.

Note that, in this state, the pivot support shafts 124 of the end guide 120 and the bearing portions 111 of the cassette 100 are not engaged with each other yet, but the extending shafts 127, the link portions 131 of the cassette 100, and the retainers 113 slide, and the end guide 120 is ready to pivot.

Operations of End Guide

Next, an operation procedure of the end guide 120 according to the present embodiment will be described.

As described above, in a state where the end guide 120 is incorporated in the cassette 100, the end guide 120 is in a state of being accommodated in the cassette 100, and the end guide 120 is hidden below the loading surface 101. Therefore, the paper bundle P1 can be loaded on the end guide 120 that is in the accommodated state.

When using the end guide 120, a finger is placed on the finger placement portion 123 of the end guide 120 in the vicinity of the finger placement hole 116 of the cassette 100, and the end guide 120 is pulled up. At this time, the extending shafts 127 of the end guide 120 are supported by the retainers 113, and thus the end guide 120 pivots with respect to the pivoting central axis 130 in a direction in which the finger placement portion 123 is lifted (arrow Y direction). When the end guide 120 pivots, the insertion surface portions 125 are twisted relative to the insertion grooves 112, and the pivot support shafts 124 are gradually engaged with the bearing portions 111 and are pivotally supported in an engaged manner.

Figure 14:
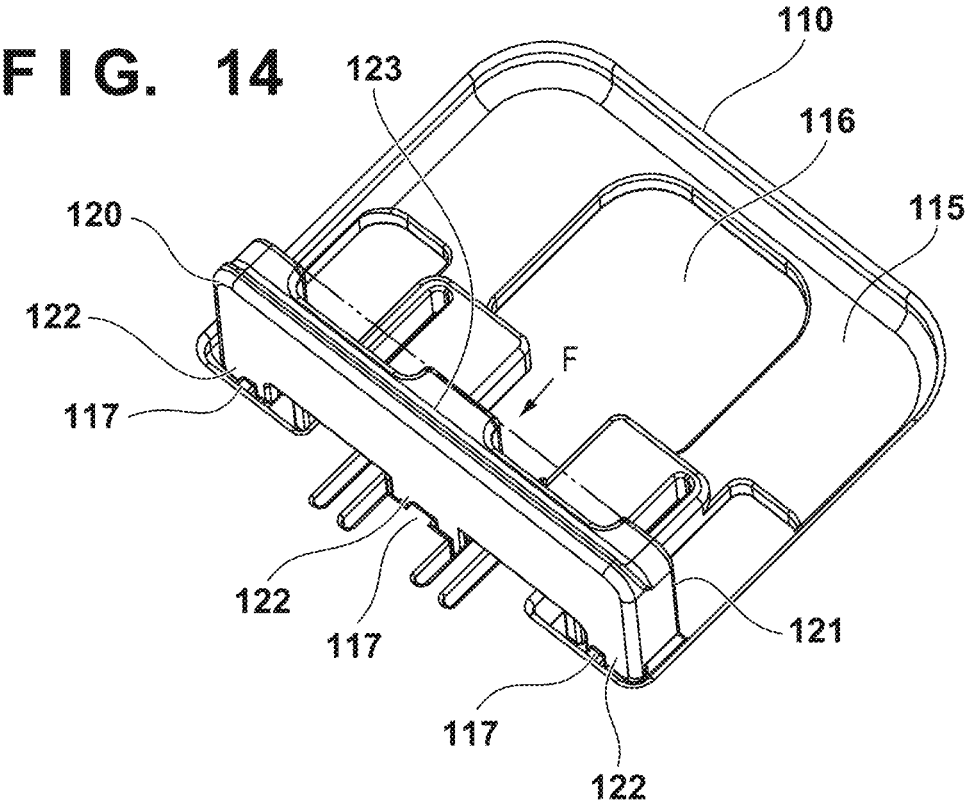
FIG. 14 is a perspective view of an end guide in an erect state.
Figure 15A:
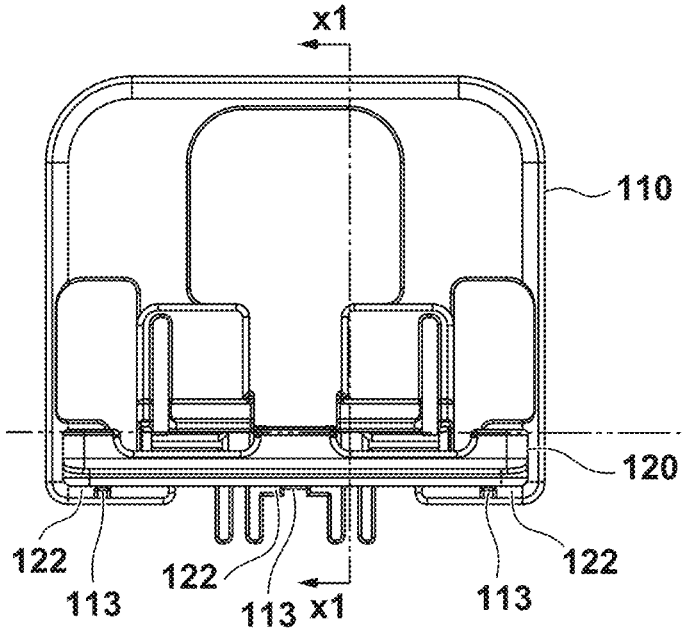
FIGS. 15A and 15B are a plan view and a cross-sectional view of an end guide in an erect state.
Figure 15B:
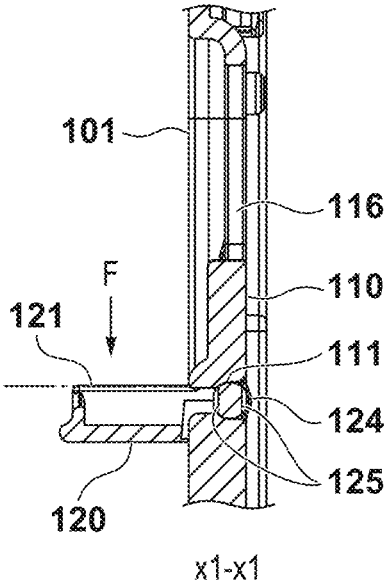
Figure 16:
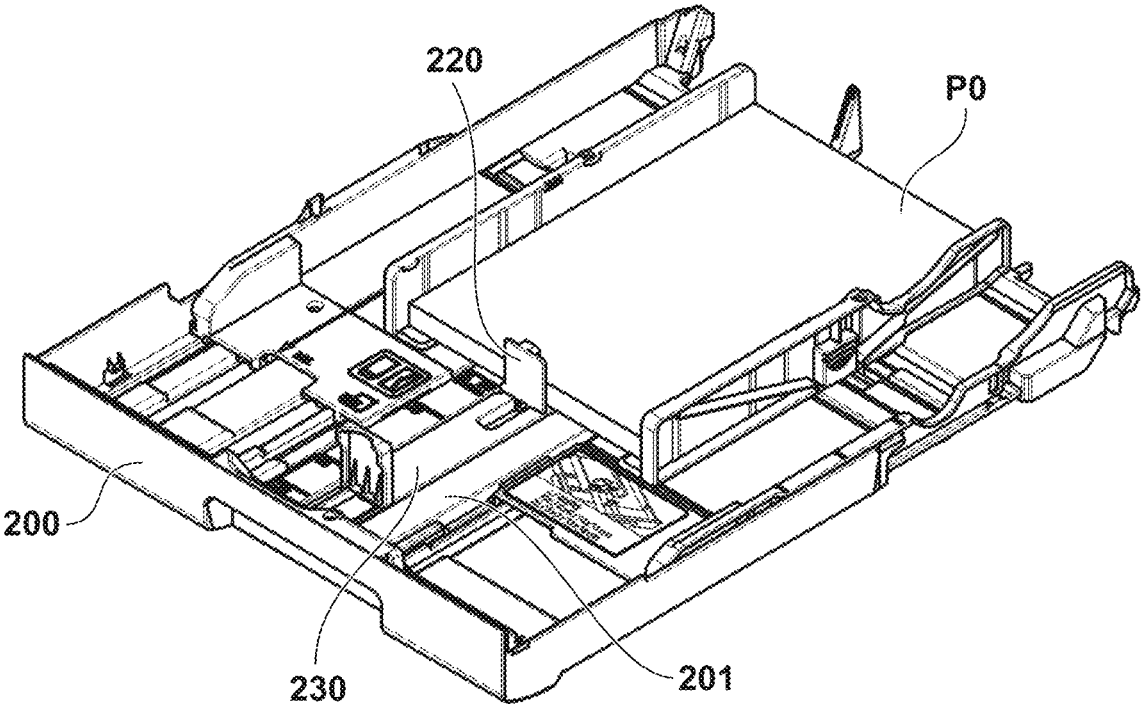
FIG. 16 is a perspective view showing the structure of a conventional end guide.
Figure 17A:
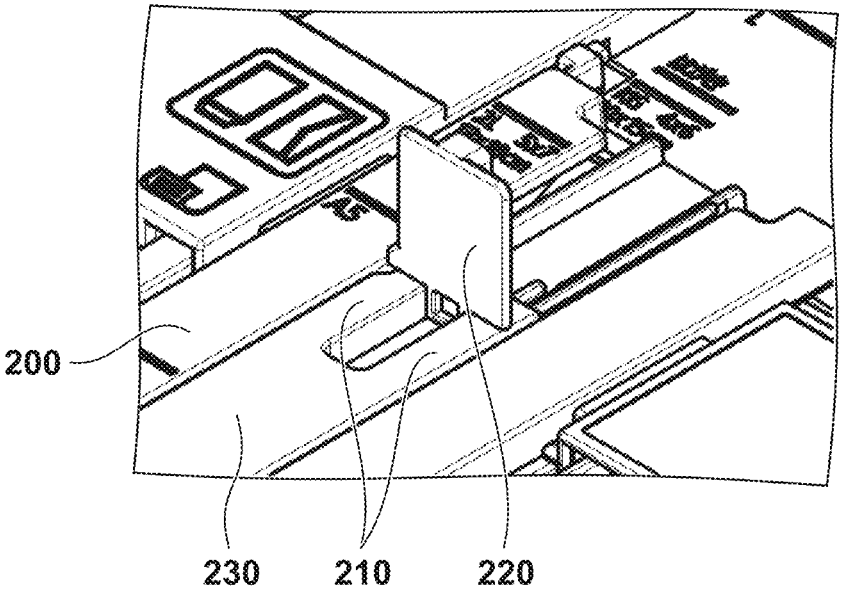
FIGS. 17A and 17B are detail views showing the structure of a conventional end guide.
Figure 17B:
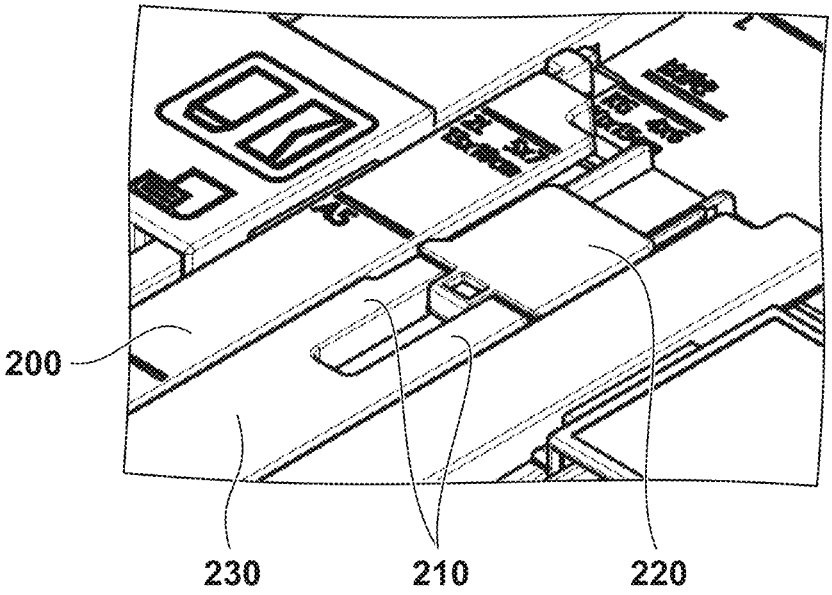

FIG. 14 is a perspective view of a state where the end guide 120 is erect in the cassette 100. FIG. 15A is a plan view of FIG. 14, and FIG. 15B is a cross-sectional view when viewed in a direction indicated by ×1 arrows in FIG. 15A.

When the end guide 120 pivots by 90° and stands erect, the end guide 120 does not come off from the bearing portions 111 since the diameter c of the pivot support shafts 124 of the end guide is larger than the gap width b of the insertion grooves 112. When the abutting portions 122 of the end guide 120 abut on load receiving portions 117 of the cassette, the guide surface 121 is held substantially vertically to the loading surface 101, and the position of the trailing edge surface PE of the paper bundle P1 can be supported. The end guide 120 is supported by the load receiving portions 117 against force of displacing the paper bundle P1 on the trailing edge side (an arrow F direction), and thus even if a sheet feed operation is repeated, stable sheet feeding can be performed without the paper bundle P1 loaded in the cassette 100 being displaced.

Since the pivot support shafts 124 are disposed near the center of the body of the end guide 120, and pivotally support the end guide 120, the rigidity is secured. Thus, it is possible to withstand an inadvertent load that is received in an erect state, due to engagement portions between the pivot support shafts 124 and the bearing portions 111 not coming off. Due to this effect, it is possible to prevent an excess load from acting on the extending shafts 127 and the retainers 113, and the end guide 120 is unlikely to be detached.

In addition, as a result of the click protrusion portions 129 of the end guide 120 moving over the flexible portions 118 of the cassette 100 while the end guide 120 is pivoting, a user can feel that "lifting is complete" when performing the operation, and it is possible to perform engagement such that the posture of the end guide 120 does not return to the original accommodated state due to its own weight.

As described above, according to the above embodiment, the bearing portions and the retaining portions of the end guide are separated, and thus the end guide can smoothly pivot between a state where the end guide immediately after being attached to the cassette is accommodated and a state where the end guide is erect, also securing the strength of the bearing portions.

In addition, since the posture of the end guide is regulated such that the end guide can be attached from the loading surface side of the cassette along the direction of the insertion grooves, it is easier to attach the end guide, and the end guide is unlikely to be detached from the cassette in the erect state.

In addition, as the effect of the chamfered shapes of the pivot support shafts and the retainers, the end guide can be attached in a single operation from one direction.

Other Variations

In the above embodiment, the end guide is disposed based on A5 and B5 paper sizes, but positions at which the end guide is disposed may be changed based on another paper size, and the number thereof may be changed.

In addition, in the above embodiment, the side guides are disposed in the cassette 100 symmetrically with respect to the center of paper, but may be disposed asymmetrically with respect to the center of paper.

In addition, in the above embodiment, the end guide is disposed to stand erect from the sheet feed direction, but may be erected from a direction perpendicular to the sheet feed direction, and positioned such that the paper bundle P1 is not displaced due to the end guide. The pivot direction of the end guide is perpendicular to a direction in which the paper bundle P1 is displaced, and thus, even if reaction force acts from the paper bundle P1, the end guide is unlikely to tilt.

Moreover, in the above embodiment, a paper guide having the above-described structure is disposed as an end guide in a cassette on the trailing edge surface PE side of a paper bundle, but a paper guide having the above-described structure may be disposed as a side guide in a cassette on a side end surface PS side of a paper bundle.

In addition, in the above embodiment, the extending shafts are provided on the ends of the pivot support shafts of the end guide, and the link portions 131 of the cassette are provided, but the pivot support shafts may be extended as is without reducing the diameter of thereof.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-133674, filed Aug. 18, 2021, which is hereby incorporated by reference herein in its entirety.

What is claimed is:

1. A cassette comprising:

a storage portion configured to include a loading surface on which a sheet is loaded;

a sheet guide configured to pivot with respect to a pivot central axis that is parallel to the loading surface, and to be capable of switching between an accommodated state where the sheet guide is parallel to the loading surface and an erect state for guiding a sheet where the sheet guide is erect from the loading surface;

a pivot support shaft extending on two sides of the sheet guide along the pivot central axis, in the sheet guide, and a bearing portion configured to pivotably support the pivot support shaft, in the storage portion;

an insertion portion formed at a portion of the pivot support shaft, and configured to have a smaller width than a diameter of the pivot support shaft;

an insertion groove formed from the loading surface toward the bearing portion, and has a smaller width than the diameter of the pivot support shaft; and a flexible pressing portion disposed outside the insertion groove, and configured to press a leading end portion of the pivot support shaft.

2. The cassette according to claim 1, wherein, in the accommodated state of the sheet guide, an insertion surface of the insertion portion is substantially perpendicular to the loading surface.

3. The cassette according to claim 2, wherein the insertion portion includes a plurality of the insertion surfaces that are opposing cut surfaces separated by a distance that is smaller than the diameter of the pivot support shaft.

4. The cassette according to claim 3, wherein the distance between the opposing cut surfaces is smaller than a width of the insertion groove.

5. The cassette according to claim 1, wherein an inclined surface is formed on at least one of a leading end of the pivot support shaft and a portion of the pressing portion that abuts against the leading end of the pivot support shaft.

6. The cassette according to claim 5, wherein an inclined surface is formed on both the leading end of the pivot support shaft and the portion of the pressing portion that abuts against the leading end of the pivot support shaft.

7. The cassette according to claim 1, wherein the storage portion further includes an accommodation space for accommodating the sheet guide such that the sheet guide does not protrude from the loading surface in the accommodated state of the sheet guide.

8. The cassette according to claim 7, comprising:

wherein the storage portion further includes, in the accommodation space, a recess portion for causing a tip of a user's finger to escape when the user erects the sheet guide using the finger.

9. The cassette according to claim 1, wherein the sheet guide includes a first guide surface at a base of the pivot support shaft, and the storage portion includes a second guide surface that slides over the first guide surface and regulates movement of the pivot support shaft of the sheet guide in a thrust direction.

10. The cassette according to claim 9, wherein the sheet guide includes a protrusion portion near the first guide surface, and the storage portion includes an engaging portion that is flexible and engages with the protrusion portion when the sheet guide stands erect from the loading surface.

11. The cassette according to claim 10, wherein the engaging portion is formed integrally with the storage portion.

12. The cassette according to claim 1, wherein the pressing portion is formed integrally with the storage portion.

13. The cassette according to claim 1, wherein the sheet guide includes an abutting portion that abuts against the storage portion in the erect state, and the storage portion includes a receiving portion that receives the abutting portion.

14. A printing apparatus in which it is possible to mount the cassette according to claim 1.

* * * * *